US006529691B2

(12) United States Patent
Guy et al.

(10) Patent No.: US 6,529,691 B2
(45) Date of Patent: Mar. 4, 2003

(54) TONER CARTRIDGE ELECTRICAL IDENTIFICATION MECHANISM

(75) Inventors: Bernard L. Guy, Rochester, NY (US); Daniel A. Chiesa, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/732,945

(22) Filed: Dec. 8, 2000

(65) Prior Publication Data

US 2002/0071683 A1 Jun. 13, 2002

(51) Int. Cl.[7] ..... G03G 15/00
(52) U.S. Cl. ..... 399/12; 399/13
(58) Field of Search ..... 399/12, 13

(56) References Cited

U.S. PATENT DOCUMENTS 6,019,461 A * 2/2000 Yoshimura et al. ..... 399/12 X
6,104,888 A * 8/2000 Kobayashi ..... 399/12
6,263,170 B1 * 7/2001 Bortnem ..... 399/13

* cited by examiner

*Primary Examiner*—William J. Royer
(74) *Attorney, Agent, or Firm*—Perman & Green, LLP

(57) ABSTRACT

A system for identifying a supply accessory in a device. The system includes a device identifier in the supply accessory and a controller adapted to measure a value of the device identifier, compare the measured value with a predetermined value and determine if the supply accessory corresponds to the device.

25 Claims, 4 Drawing Sheets

TONER CARTRIDGE ELECTRICAL IDENTIFICATION MECHANISM

BACKGROUND OF THE INVENTION

1. Field of the Invention

The present invention relates generally to supply accessories for printing systems and, more particularly, to identifying a source of a consumer replaceable unit.

2. Brief Description of Related Developments

Toner cartridge configuration control is a key aspect of Xerox™ Corporation customers on some product lines. To protect the revenue generated from consumable sales after equipment sales, it is helpful to be able to identify the source of the consumable. Presently, a physical keying system and/or an electronic consumer replaceable unit mechanism unique to each customer is provided. The current method used for identification and keying is to utilize a ROM chip mounted to the consumable that interfaces with the machine. It would be beneficial to be able to positively identify the configuration of a toner cartridge and prevent "garage refillers" from altering a physical key on the cartridge.

SUMMARY OF THE INVENTION

The present invention is directed to, in a first aspect, a system for identifying a supply accessory in a device. In one embodiment, the system comprises a device identifier in the supply accessory and a controller adapted to measure a value of the device identifier, compare the measured value to a predetermined value and determine if the supply accessory corresponds to the device.

In a second aspect, the present invention is directed to a method of identifying a supply accessory in a device. In one embodiment, the method comprises measuring a value of a device identifier in the supply accessory. The measured value is compared to a predetermined value and an identification signal corresponding to a result of the comparison is transmitted to the device.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
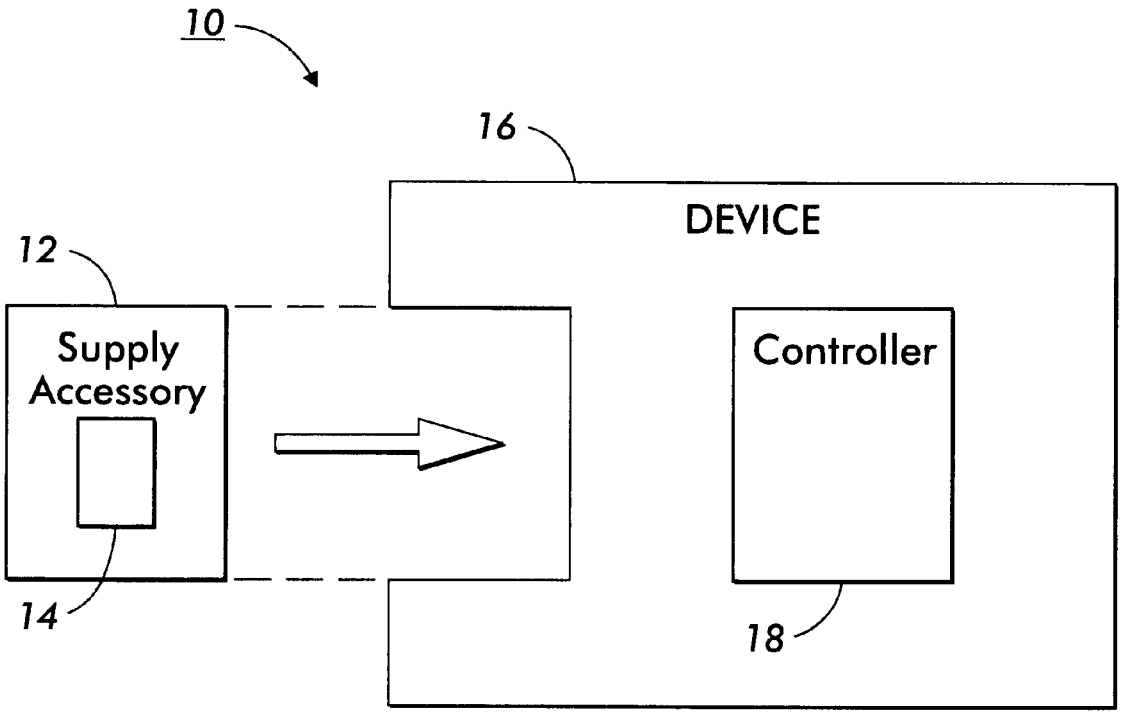
FIG. 1 is a block diagram of a system incorporating features of the present invention.

Referring to FIG. 1, a block diagram of a system 10 incorporating features of the present invention is shown. Although the present invention will be described with reference to the embodiments shown in the drawings, it should be understood that the present invention can be embodied in many alternate forms of embodiments. In addition, any suitable size, shape or type of elements or materials could be used.

The system 10 generally comprises a device or apparatus 16 and a supply accessory 12. The supply accessory 12 is generally adapted to be a functional component of the device 16. In one embodiment, the supply accessory 12 is adapted to be physically inserted and connected to the device 16. For example, device 16 could comprise a printing device, and the supply accessory 12 can be a toner cartridge. Generally, the supply accessory 12 comprises a customer-replaceable unit ("CRU") or consumable such as a toner bottle or toner cartridge in a printing or copying system. In alternate embodiments, the supply accessory 12 can be any suitable type of removable or replaceable component of the device 16.

Figure 2:
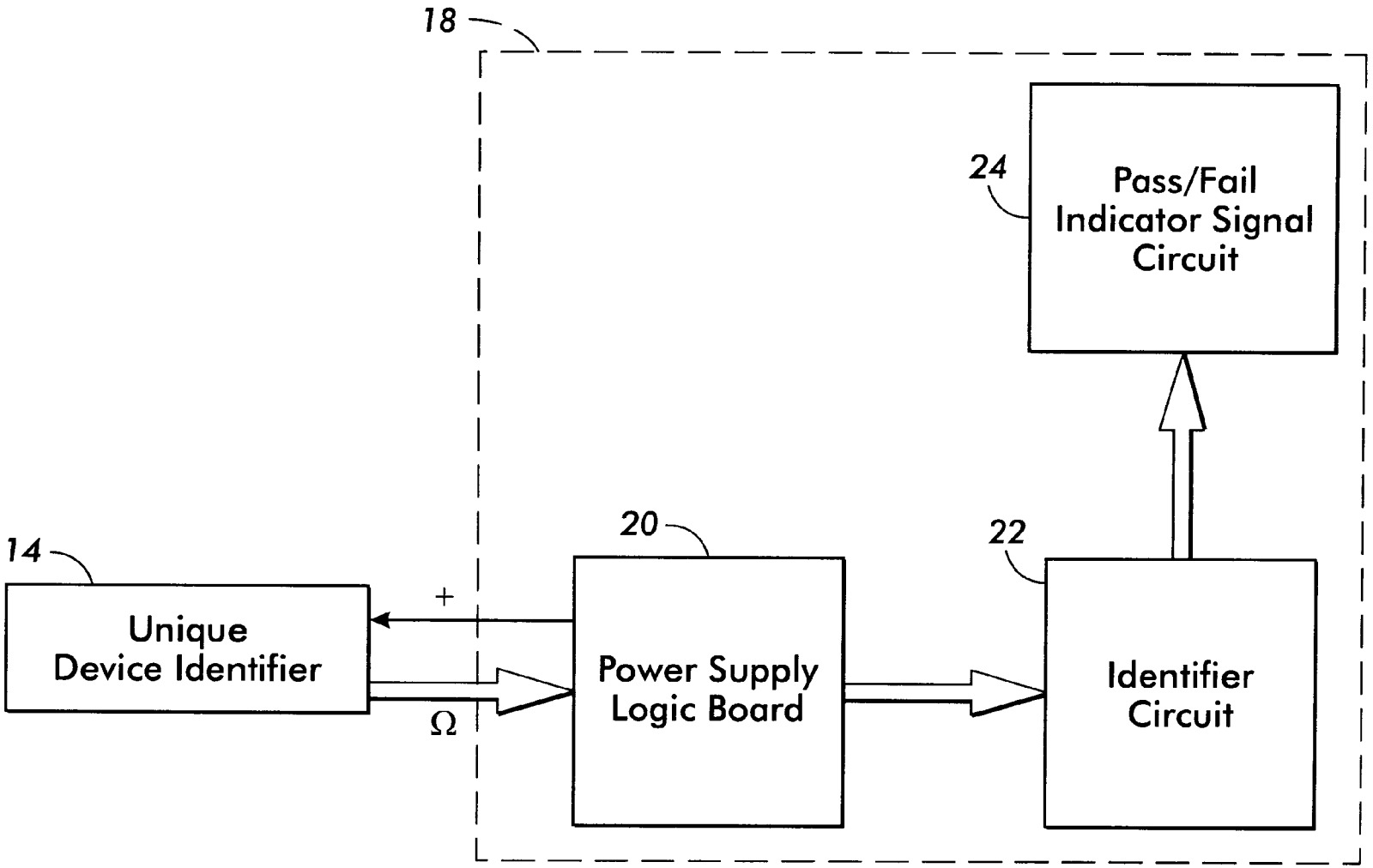
FIG. 2 is a block diagram of one embodiment of a system incorporating features of the present invention.

Device 16 can also include a controller 18. Controller 18 is generally adapted to detect a unique device identifier 14 in the supply accessory 12. The controller 18 is generally adapted to determine if the supply accessory 12 is unique to the device 16. Referring to FIG. 2, in one embodiment, the controller 18 can include a connection to a power supply logic board 20, an identifier circuit 22 and a pass/fail indicator signal circuit 24 that can be displayed, for example on a user interface panel. The identifier circuit 22 could comprise for example, a comparator circuit that is adapted to analyze the unique device identifier 14 and determine if the supply accessory 12 is appropriate for the device 16. In an alternative embodiment, any suitable circuit can be used. The identifier circuit 22 is generally adapted to compare a voltage change of the unique device identifier 14, which in one embodiment comprises a resistive element. The identifier circuit 22 is generally adapted to query the supply accessory 12 upon installation or start-up of the device 16. The resistance value of the unique device identifier 14 can be measured by the device 16 and compared to a theoretical value stored or hardwired in the identifier circuit 22. The results of the comparison can be interpreted by the pass/fail indicator signal circuit 24, which can then transmit a pass/fail signal. Different theoretical values can be set in each device 16 to meet a customer's requirements. In one embodiment, the theoretical values can be hardwired into the device 16. Alternatively, the theoretical values could be stored in the device 16 in any suitable fashion, such as for example, a memory device or a setting in the device 16. In one embodiment, if the actual measured value is outside a target range, the device 16 can show an error and become inoperative. A measured value that is within the target range can allow normal operation of the device 16.

Generally, when the supply accessory is installed in the device 16, an electrical connection is established between the controller 18 and the unique device identifier 14. The unique device identifier 14 generally comprises a resistive device. The resistive device can comprise for example, a surface mounted piece of electrically conductive plastic, or a manufactured resistor device mounted in a custom connector or imbedded in the supply accessory. In alternate embodiments, the unique device identifier 14 could comprise any suitable resistive device.

Figure 3:
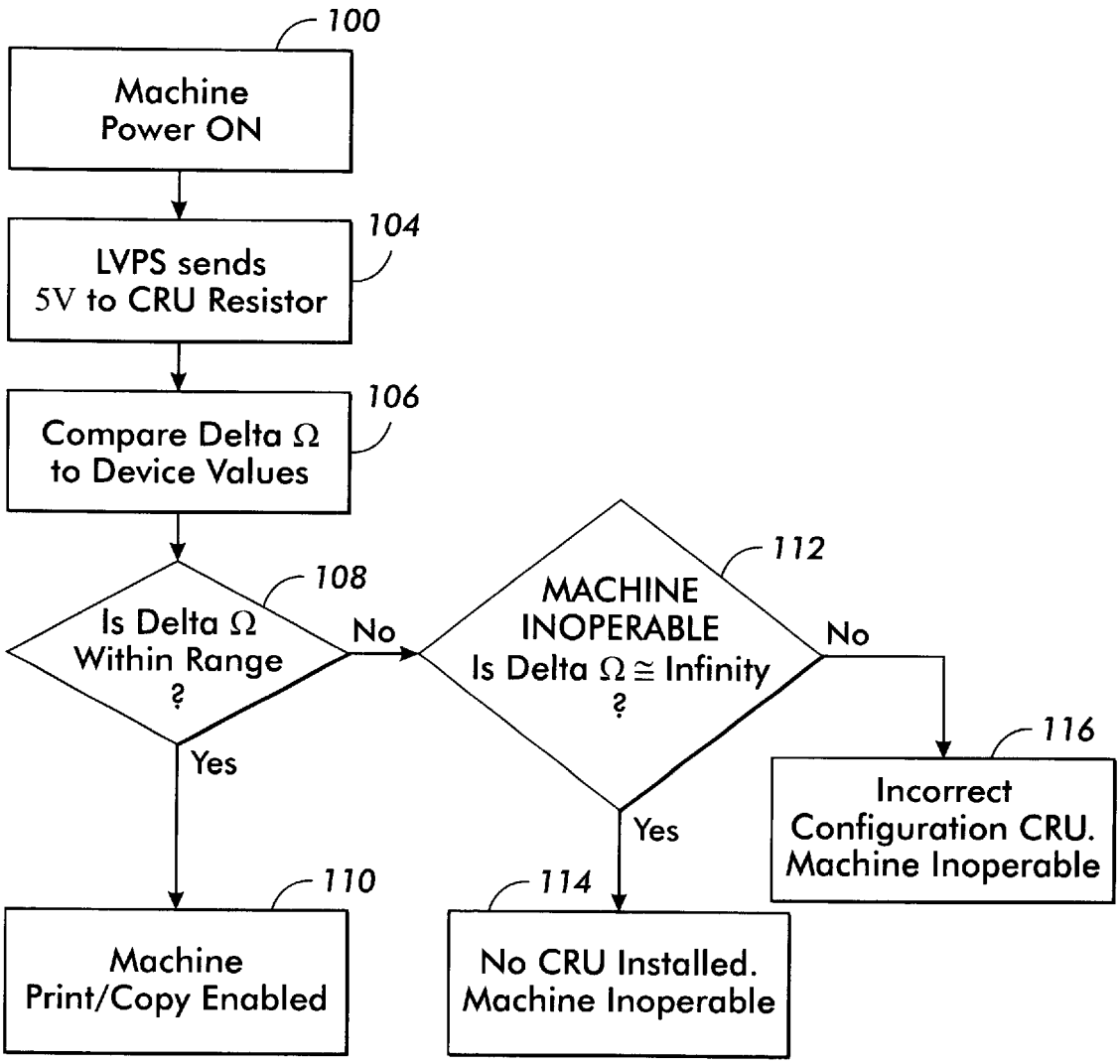
FIG. 3 is a flow chart of a method incorporating features of the present invention.

Referring to FIG. 3, a method incorporating features of the present invention is described. Generally, after the supply accessory 12 is installed, the device 16 is powered on (step 100). Alternatively, the supply accessory 12 could be installed after the device 16 is powered on. A power supply, such as for example a low voltage power supply that can be part of the controller 18, sends (step 104) a voltage signal to the unique device identifier 14 of the supply accessory 12. The voltage signal can be for example, a low voltage signal. In one embodiment, a power source can be adapted to supply a 5-volt signal. A resistance value of the unique device identifier 14 or a change in a voltage across a resistance of the unique device identifier 14 is compared (step 106) to the theoretical value or range stored in the device 16. If the resistance or the change in voltage is within the predetermined range (step 108), the device 16 is enabled (step 110). If the change in voltage, or the resistance value is not within the predetermined range, the device 16 can be rendered for example, inoperable (step 112) and a further comparison can be made to determine if the supply accessory 12 is properly installed in the device 16. If for example, the resistance is approaching infinity that can be an indication (step 114) that the supply accessory 12 is not installed in the device 16. Otherwise, the determination (step 116) can be that the supply accessory 12 is an incorrect configuration for the device 16.

Figure 4:
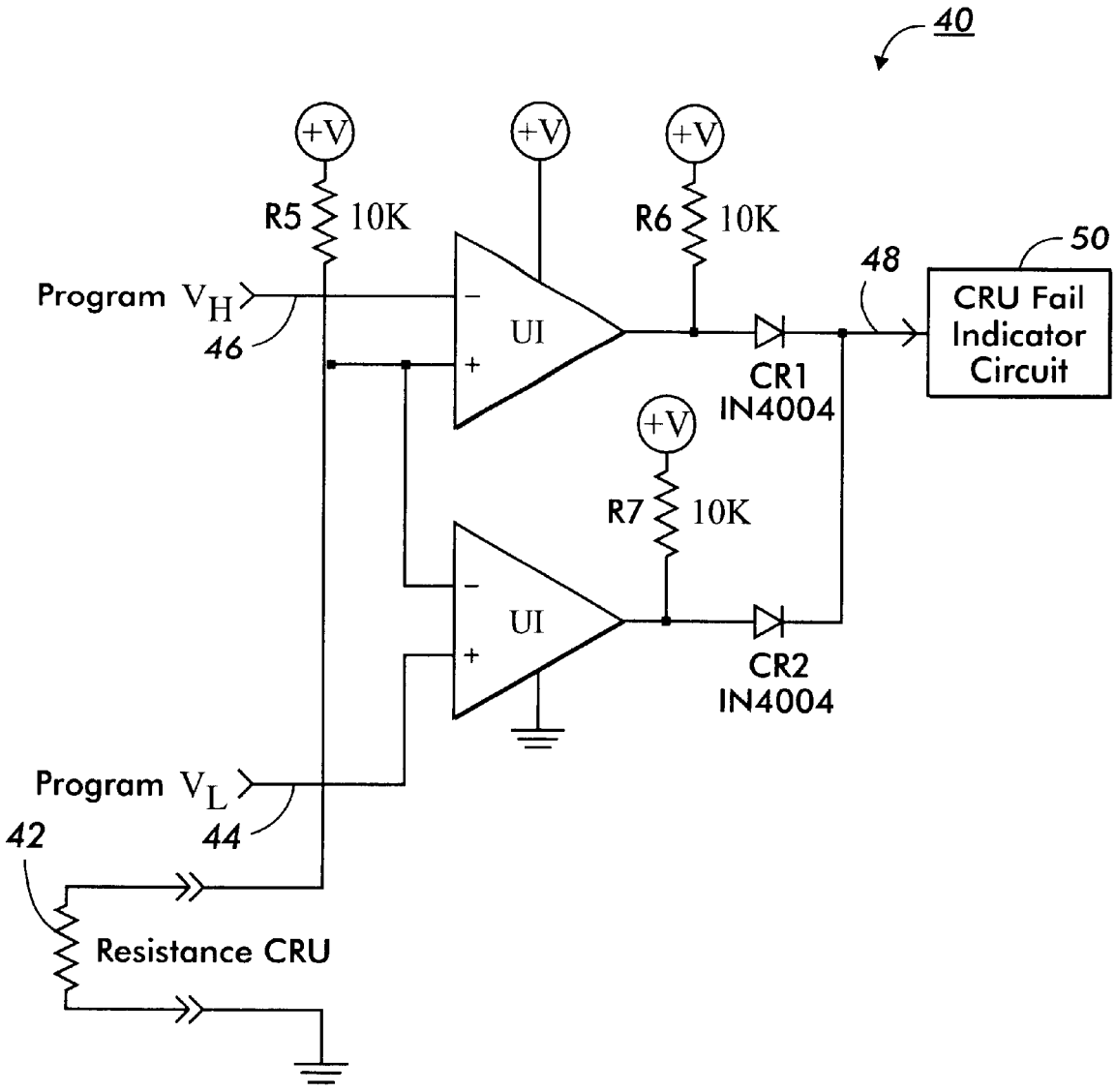
FIG. 4 is a schematic diagram of a circuit that can be used to practice the present invention.

Referring to FIG. 4, a schematic of an identifier circuit 40 that may be applied to practice in the present invention is shown. The identifier circuit 40 can comprise a comparator circuit that compares a resistance value or a voltage change across a resistance value 42 in the device 16. In an alternate embodiment, any suitable circuit that can detect and compare resistance values or a voltage change across a resistance can be used. The identifier circuit 40 can be part of the device 16. The resistance value 42 or voltage change measured by the device 16 can be compared to a theoretical value stored in the identifier circuit 40 provided by inputs $V_H$ 46 and $V_L$ 44. Inputs 44 and 46 can be programmed for each device 16 to meet customer requirements. A pass/fail signal 48 can be sent to an indicator circuit 50.

By embedding a small distinct resistor of a known value in a supply accessory such as a toner cartridge or bottle for each OEM customer, the machine logic of the device via a simple window comparator circuit can read or identify the resistor value and accept the toner bottle as original or as an acceptable replacement. The system could be used for OEM applications where each manufacturer would have their own unique CRU to be used in the device or machine.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. A system for identifying a supply accessory in a device comprising:

a device identifier in the supply accessory, the device identifier comprising an electrically conductive resistive element mounted on or in a surface of the supply accessory; and a controller in the device comprising a window comparator adapted to:

measure a value of the device identifier;

compare the measured value with a predetermined value preset by the window comparator; and enable or disable the supply accessory depending on the comparison.

2. The system of claim 1 wherein the controller is adapted to measure a resistance of the resistive element.

3. The system of claim 2 wherein the resistive element is a resistor device mounted in a connector of the supply accessory.

4. The system of claim 1 wherein the controller is adapted to measure a voltage across the resistive element.

5. The system of claim 1 wherein the device identifier has a resistance value and the window comparator comprises a three resistor comparator circuit wherein each resistor is chosen in order to program a window of resistance values within which the measured value must fall in order for the device to be enabled.

6. The system of claim 1 wherein the supply accessory is a consumer replaceable unit.

7. The system of claim 1 wherein the supply accessory is a toner cartridge.

8. The system of claim 1 wherein the device identifier is a resistor.

9. The system of claim 1 wherein the device identifier is a surface mounted piece of electrically conductive plastic on the supply accessory.

10. The system of claim 1 wherein the predetermined value comprises a range of values and the device is enabled if the measured value is within the range and disabled if the measured value is outside the range.

11. The system of claim 1 wherein the window comparator includes three resistors, the resistors chosen in order to establish a range of resistance values into which the resistance of the identifier can fall in order to enable the device.

12. The system of claim 1 wherein the device identifier on the supply accessory forms an integral part of a circuit of the window comparator.

13. The system of claim 12 wherein a voltage formed across the device identifier when the supply accessory is inserted into the device is compared to preset voltages applied to the window comparator circuit in order to enable or disable the supply accessory.

14. A method of enabling a device based on identifying a supply accessory in the device comprising the steps of:

using a window comparator to measure a value of a device identifier in the supply accessory, the device identifier comprising an electrical conductive material embedded in or on a surface of the supply accessory;

comparing the measured value to a predetermined range of values; and transmitting an identification signal to the device corresponding to a result of the comparison, the identification signal adapted to enable or disable the device depending on whether the measured value falls within the predetermined range of values.

15. The method of claim 14 wherein the step of measuring a value of a device identifier comprises the step of measuring a resistance value of a resistive element in the device identifier.

16. The method of claim 14 wherein the step of measuring a value of a device identifier comprises the step of measuring a voltage change across a resistance of a resistive element in the device identifier.

17. The method of claim 14 wherein the step of measuring a value of a device identifier comprises the steps of:

supplying a low voltage signal to the device identifier; and measuring a voltage change across the device identifier.

18. The method of claim 14 wherein the step of comparing comprises the step of using a comparative circuit to compare a voltage change across the device identifier with the predetermined value.

19. The method of claim 14 further comprising the step of rendering the device inoperable if the measured value does not correspond with the predetermined value.

20. The method of claim 14 further comprising the step of, prior to the step of measuring a value of a device identifier, of establishing an electrical connection between the device identifier in the supply accessory and the device.

21. The method of claim 14 wherein the window comparator is a three-resistor window comparator circuit.

22. A system for identifying a supply accessory adapted to be connected to a device comprising:

a device identifier in the supply accessory, the device identifier comprising a resistive element embedded in a surface of the supply accessory; and a controller in the device, the controller adapted to measure a resistance of the resistive element, compare the measured value with a predetermined value and determine if the supply accessory is compatible with the device.

23. The system of claim 22 wherein the device is a xerographic device.

24. The system of claim 22, the controller further comprising a programmable memory device adapted to be adjusted by the user, the memory device adapted to be programmed for a specific supply accessory.

25. A system for enabling or disabling a device when an accessory is inserted into the device comprising:

an identifier comprising a resistive element in or on the accessory; and a window comparator in the device adapted to measure a value of the identifier when the identifier is inserted into the device, the window comparator including at least one resistive value adapted to be preset, the resistance value establishing a range of values which the value of the identifier must fall in order to enable the device.

* * * * *